US011448389B1

(12) United States Patent
Jenkins et al.

(10) Patent No.: US 11,448,389 B1
(45) Date of Patent: Sep. 20, 2022

(54) LUMINAIRES WITH MODULAR HEAT SPREADER PANELS

(71) Applicant: Dialight Corporation, Farmingdale, NJ (US)

(72) Inventors: Kenneth Jenkins, Farmingdale, NJ (US); Samual Boege, Farmingdale, NJ (US); David Weimer, Farmingdale, NJ (US); Christian Vorrius, Farmingdale, NJ (US); Kevin Hebborn, Farmingdale, NJ (US)

(73) Assignee: Dialight Corporation, Farmingdale, NJ (US)

( * ) Notice: Subject to any disclaimer, the term of this patent is extended or adjusted under 35 U.S.C. 154(b) by 0 days.

(21) Appl. No.: 17/674,171

(22) Filed: Feb. 17, 2022

(51) Int. Cl.
*F21V 29/78* (2015.01)
*F21V 29/74* (2015.01)

(52) U.S. Cl.
CPC ..... *F21V 29/78* (2015.01); *F21V 29/74* (2015.01)

(58) Field of Classification Search
CPC ..... F21V 29/78; F21V 29/73; F21V 29/70; F21V 29/74; F21V 29/745
USPC ..... 362/373
See application file for complete search history.

(56) References Cited

U.S. PATENT DOCUMENTS

| | | | | |
|---|---|---|---|---|
| 9,538,620 | B2 * | 1/2017 | Kim | H05B 47/19 |
| 10,222,047 | B2 * | 3/2019 | Kadijk | F21V 29/503 |
| 2011/0074265 | A1 * | 3/2011 | Van De Ven | F21S 8/02 313/46 |
| 2018/0235057 | A1 * | 8/2018 | Choi | F21V 29/70 |

FOREIGN PATENT DOCUMENTS

| | | | | |
|---|---|---|---|---|
| EP | 3144591 B1 * | 6/2018 | | B29C 45/40 |
| KR | 10-1504262 * | 3/2015 | | B29C 45/40 |

* cited by examiner

*Primary Examiner* — Laura K Tso
(74) *Attorney, Agent, or Firm* — Tong, Rea, Bentley & Kim, LLC

(57) ABSTRACT

The present disclosure is directed to examples of a single modular heat spreader piece. In one example, the single modular heat spreader piece includes a body portion, wherein the body portion comprises a curved outer surface and a flange member coupled to a first side of the body portion, wherein the flange member has a curved outer edge, a connection member coupled to a second side of the body portion, wherein the second side of the body portion is opposite the first side, and a heat spreader member coupled to the second side of the body portion and on an opposite end of the body portion from the connection member.

20 Claims, 5 Drawing Sheets

LUMINAIRES WITH MODULAR HEAT SPREADER PANELS

BACKGROUND

Luminaires can be used to illuminate an area. Luminaires can include various types of light sources such as incandescent light bulbs or light emitting diodes (LEDs). Currently, LEDs are preferred due to lower energy usage and the ability to provide sufficient light output.

Some LED luminaires can be used for commercial applications. The luminaires can be located in warehouses or commercial work sites to provide large amounts of light output. The luminaires can come in a variety of different sizes depending on the desired light output.

The LEDs in the luminaires can generate large amounts of heat. The heat can be dissipated through various mechanisms such as heat sinks. Dissipating the heat away from the LEDs and out of the luminaires can ensure that the LEDs have a longer lifespan and that the luminaires function properly.

SUMMARY

In one embodiment, the present disclosure provides a single modular heat spreader piece. In one embodiment, the single modular heat spreader piece comprises a body portion, wherein the body portion comprises a curved outer surface and a flange member coupled to a first side of the body portion, wherein the flange member has a curved outer edge, a connection member coupled to a second side of the body portion, wherein the second side of the body portion is opposite the first side, and a heat spreader member coupled to the second side of the body portion and on an opposite end of the body portion from the connection member.

In one embodiment, the present disclosure provides a modular heat spreader for a luminaire. The modular heat spreader for a luminaire comprises a plurality of single modular heat spreader pieces coupled together. Each one of the plurality of single modular heat spreader pieces comprises a body portion, wherein the body portion comprises a curved outer surface and a flange member coupled to a first side of the body portion, wherein the flange member has a curved outer edge, a connection member coupled to a second side of the body portion, wherein the second side of the body portion is opposite the first side, and a heat spreader member coupled to the second side of the body portion and on an opposite end of the body portion from the connection member.

In one embodiment, the present disclosure provides a high bay luminaire. The high bay luminaire comprises a housing comprising a twist lock connector, a modular heat spreader coupled to the housing, wherein the modular heat spreader comprises a plurality of single modular heat spreader pieces coupled together, a printed circuit board comprising a plurality of light emitting diodes (LEDs), wherein the printed circuit board is coupled to the heat spreader member, and a lens coupled to the housing to enclose the modular heat spreader and the printed circuit board. Each one of the plurality of single modular heat spreader pieces comprises a body portion, wherein the body portion comprises a curved outer surface and a flange member coupled to a first side of the body portion, wherein the flange member has a curved outer edge, a connection member coupled to a second side of the body portion, wherein the second side of the body portion is opposite the first side, and a heat spreader member coupled to the second side of the body portion and on an opposite end of the body portion from the connection member.

BRIEF DESCRIPTION OF THE DRAWINGS

So that the manner in which the above recited features of the present disclosure can be understood in detail, a more particular description of the disclosure, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1:
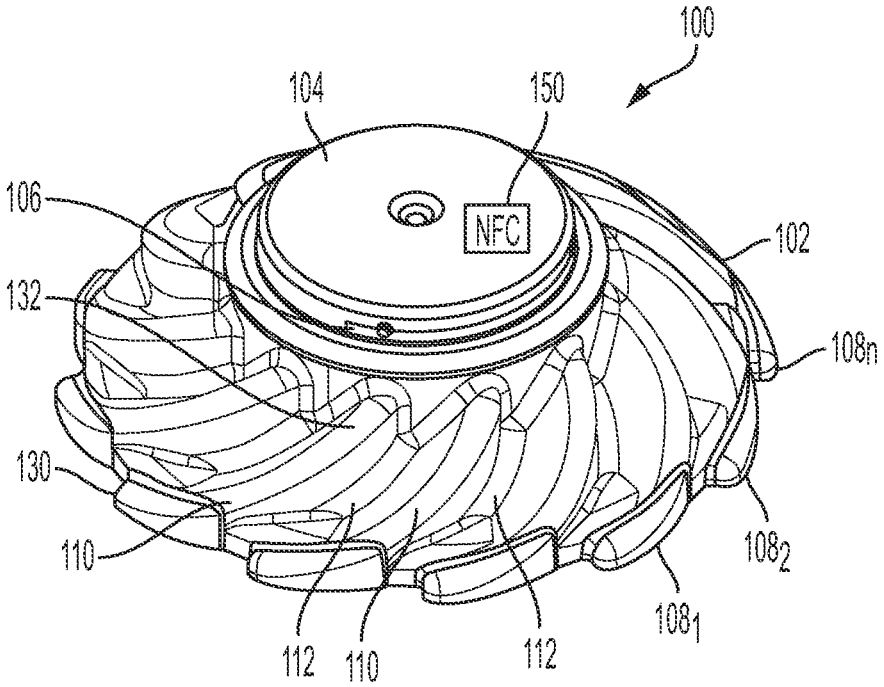
FIG. 1 depicts an isometric top view of an example high bay luminaire of the present disclosure.

The present disclosure provides a next generation high bay luminaire with a modular heat spreader panel. As noted above, some LED luminaires can be used for commercial applications. The luminaires can be located in warehouses or commercial work sites to provide large amounts of light output. The luminaires can come in a variety of different sizes depending on the desired light output.

The LEDs in the luminaires can generate large amounts of heat. The heat can be dissipated through various mechanisms such as heat sinks. Dissipating the heat away from the LEDs and out of the luminaires can ensure that the LEDs have a longer lifespan and that the luminaires function properly.

The commercial applications may require ingress protection (IP) seals to protect against environmental contaminations. IP seals are presently made by die cast enclosures that are well suited to replicating the complex geometries associated with sealing. Die cast parts can become heavy and large as luminaire wattage increases above 50 watts (W). Large die cast heat sinks become heavy as wall thickness cannot be reduced due to safety certification and tooling limitations. Heavy die casts are problematic for global supply chains, with large heavy metal parts shipped across the globe. This can lead to poor stacking efficiency in shipping containers.

Secondary processes like machining and power coating/paint increase manufacturing complexities, add excessive labor and overhead costs, and increase the carbon foot print and environmental impact of the manufactured component. It is desirable to move from aluminum die cast parts to injection molded polymeric enclosures since the polymeric enclosures are well suited to reproduce complex geometries in high volume, are light weight, reduce the burden on global supply chains, have much lower carbon footprints, and do not require any secondary processing.

Moreover, having different sized parts for different sized high bay luminaires can create increased inventory costs and inefficient assembly of the high bay luminaires. The present disclosure uses a single modular heat spreader piece that can be combined with other modular heat spreader pieces to form different sized heat spreader panels for the high bay luminaires.

In one embodiment, the modular heat spreader pieces can be connected together to form a shape that matches the shape of the housing of the high bay luminaire. In one embodiment, the modular heat spreader pieces can be combined to form circular heat spreader panels of different diameters. As a result, a single part can be used to form the heat spreader panels of different sized high bay luminaires.

In one embodiment, the next generation high bay luminaire of the present disclosure may include additional features. For example, the high bay luminaire of the present disclosure may also include a twist lock feature that allows different mounting accessories to be attached to the high bay luminaire. Thus, a single high bay luminaire may be installed via different mechanisms by changing the mounting accessory.

In one embodiment, the next generation high bay luminaire may also include a near field communication (NFC) tag for improved safety and maintenance of the high bay luminaire. The NFC tag may collect maintenance information and provide safety features. The NFC tag may allow data to be read and written to memory in the high bay luminaire. The NFC tag may also allow for digital twin redundancy of the high bay luminaire by accessing digital twin assets via an NFC link presented by the NFC tag.

The design of the high bay luminaire may also provide improved heat dissipation and improved heat performance. Thus, the next generation high bay luminaire of the present disclosure may provide a luminaire that provides lower inventory and assembly costs, as well as additional electronic and mechanical features that are improvements over current high bay luminaire designs.

The high bay luminaire may also provide manufacturability improvements including a push to assembly features that are impossible with die cast enclosures. This may result in faster assembly times, fewer components in the build of materials (BOM), and less rework.

FIG. 1 illustrates an example high bay luminaire 100 (also referred to as luminaire 100) of the present disclosure. In one embodiment, the luminaire 100 may be a high powered, high lumen light source (e.g., greater than 50 (W)) for commercial/industrial applications.

FIG. 1 illustrates an isometric top view of the luminaire 100. In one embodiment, the luminaire 100 may include a housing 102. The housing 102 may be a metallic housing fabricated from any type of metal or steel or a plastic housing fabricated from various polymeric materials that are capable of dissipating heat away from the housing 102. The internal components may reduce a power density of a high power driver and the light emitting diodes (LEDs), thereby allowing heat to transfer effectively through low thermal conductivity materials, such as plastic and stainless steel.

In one embodiment, the housing 102 may have an irregular shaped surface that has an overall generally circular shape. The circular shape may correspond to the circular shape formed by a modular heat spreader 114, illustrated in FIG. 2 and discussed in further detail below. The circular shape may be formed by a plurality of heat sink fins $\mathbf{108}_1$ to $\mathbf{108}_n$ (hereinafter also referred to individually as a heat sink fin 108 or collectively as heat sink fins 108). The heat sink fins 108 may also provide the irregular shape (e.g., wavy appearance with peaks and valleys between the heat sink fins 108) to provide an extended surface and to enhance heat transfer.

In one embodiment, the heat sink fins 108 may have a curved shape. The curved shape may start at a point 130 of the heat sink fin 108 and may gradually increase in height to a base 132. The heat sink fins 108 may wrap around adjacent heat sink fins 108 to form the overall circular shape. The heat sink fins 108 may be connected to form alternating peaks 110 and valleys 112 that create the overall irregular surface of the housing 102. The shape of the heat sink fins 108 and the alternating peaks 110 and valleys 112 between adjacent heat sink fins 108 provide a maximum amount of surface area. The large amount of surface area may help to dissipate more heat away from the luminaire 100, thereby prolonging the life of the light emitting diodes (LEDS) 120 (shown in FIG. 2) and operation of the luminaire 100.

In one embodiment, the housing 102 may also include a base 104 that may include a twist lock connector 106. The twist lock connector 106 may include a thread and protrusion that allows a corresponding twist lock connector 106 to easily connect to or disconnect from the base 104. As discussed in further detail below and shown in FIG. 8, the twist lock connector 106 may allow for various accessories to be installed on to the base 104.

In one embodiment, the housing 102 may also include a near field communication (NFC) tag 150. The NFC tag 150 may be a passive communication device that can store and transmit information related to the luminaire 100. For example, the NFC tag 150 may store information transmitted by a mobile device or electronic device of a technician. The NFC tag 150 may also be read by the mobile device or electronic device of a technician to transmit information to be displayed on the mobile device or electronic device of the technician.

In one embodiment, the NFC tag 150 may store part information. For example, the NFC tag 150 may store models and serial numbers of parts used in the luminaire 100 (e.g., the electronic components, the drivers, the LEDs, and the like).

In one embodiment, the NFC tag 150 may store maintenance information. For example, the maintenance information may include a current operating life of electronic components (e.g., the driver, power supply, LEDs, and the like), a maintenance history of when the luminaire 100 was repaired, an error log of the luminaire 100, and the like.

In one embodiment, the NFC tag 150 may include operational or maintenance manuals. For example, a technician may scan the NFC tag 150 to determine various operational parameters of the luminaire 100. The maintenance manuals may provide detailed instructions with drawings to the mobile device of the technician, where the instructions and drawings may include instructions on how to open the housing 102, drawings of various electrical connections within the luminaire 100, and the like.

In one embodiment, the NFC tag 150 may be communicatively coupled to a processor or controller (e.g., illustrated in FIG. 9, and discussed in further detail below). The controller may prevent operation of the luminaire 100 if a maintenance operation is overdue based on the maintenance history stored in the NFC tag 150. In another example, a lock (not shown) on the housing 102 may be communicatively coupled to the NFC tag 150. The housing 102 may be locked out if a safety error occurs and is logged by the NFC tag 150.

In one embodiment, the NFC tag 150 may include twin asset data. For example, the twin asset data information can be accessed through a link provided by the NFC tag 150. The twin asset data may include LED critical operational parameters such as temperature, drive current, device model information, driver critical operational parameters, environmental data, and the like. The driver critical operational parameters may include parameters such as output voltage, drive current, input voltage, run time, temperature, and a number of on/off cycles. The environmental data may include data such as ambient light levels, humidity, temperature, and air quality.

Figure 2:
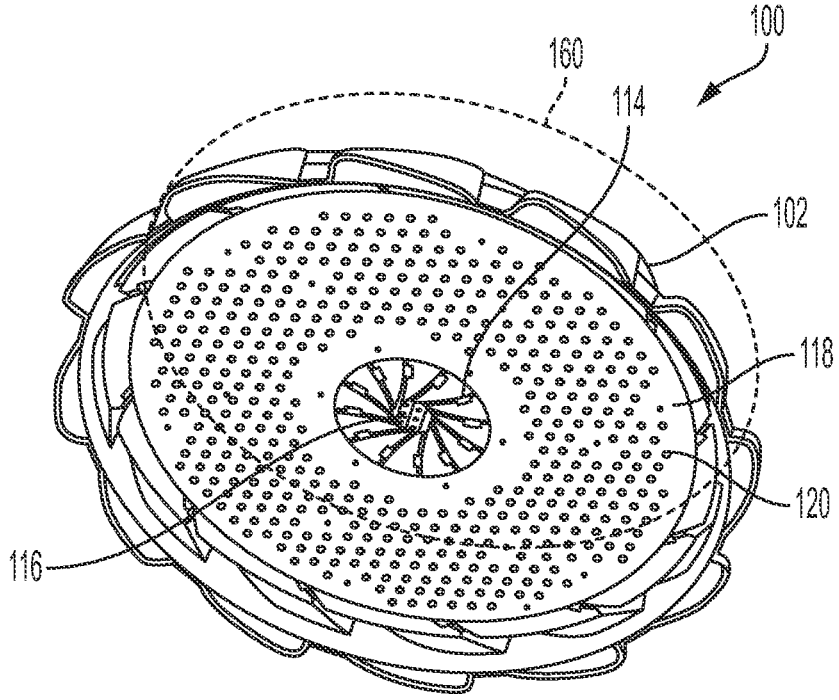
FIG. 2 depicts an isometric bottom view of the example high bay luminaire of the present disclosure.

FIG. 2 illustrates a bottom isometric view of the luminaire 100. In one embodiment, the luminaire 100 may include a modular heat spreader 114, a printed circuit board (PCB) 118 having a plurality of LEDs 120, and a lens 160. In one embodiment, the modular heat spreader 114 and the PCB 118 may be enclosed by the housing 102 and the lens 160.

In one embodiment, the lens 160 may be a clear optic fabricated from glass or plastic. In one embodiment, the lens 160 may include optical features (not shown) to control how light emitted by the LEDs 120 is redistributed out of the luminaire 100. For example, the optical features may collimate the light to a desired beam spread, may reflect the light to increase the beam spread over a wider area, may redirect light above a certain angle back towards a target area, and the like.

In one embodiment, the PCB 118 may be fabricated from a conductive metal. For example, the PCB 118 may be fabricated with an aluminum core, or a glass fiber epoxy laminate such as FR4 due to the mid power LEDs 120 having a lower power density. The LEDs 120 may be electrically coupled to the PCB 118. The LEDs 120 may be individually controlled and operated, may be grouped into arrays that include subsets of LEDs 120, or all of the LEDs 120 may be controlled as a single group of LEDs 120.

The LEDs 120 may be powered by a power source of driver (not shown) that is located inside of the housing 102 and below the modular heat spreader 114. Additional electrical components that are not shown may also be located inside of the housing 102 and below the modular heat spreader 114. For example, the luminaire 100 may include various communication modules, power supplies, surge protection modules, and the like.

In one embodiment, the modular heat spreader 114 may include a center opening 116 that provides a pathway for electrical connections. For example, the driver or power supply may be electrically connected to the PCB 118 and/or LEDs 120 via wiring that is run through the center opening 116.

In one embodiment, the modular heat spreader 114 may be also fabricated from a conductive metal. For example, the modular heat spreader 114 may be fabricated from aluminum. The modular heat spreader 114 may have a circular shape that has a diameter that is at least as large as a diameter of the PCB 118. Thus, the modular heat spreader 114 may dissipate a maximum amount of heat away from the PCB 118 towards the heat sink fins 108 of the housing 102.

In one embodiment, the modular heat spreader 114 may be fabricated by combining individual pieces together. The modular design of the modular heat spreader 114 may allow any desired number of the pieces to be coupled together to form differently sized modular heat spreaders 114. Thus, a single part may be used to form multiple differently sized modular heat spreaders 114. This may reduce inventory costs and allow for more efficient assembly of luminaires 100 of different sizes.

In addition, the design of the modular heat spreader 114 may allow for easier size scaling of the luminaire 100. For example, as more light output is needed for new applications, the size of the PCB 118 may be increased to accommodate more LEDs 120. To make a corresponding increase to the size of the modular heat spreader 114, additional pieces may be added rather than redesigning a new heat spreader with a larger size and keeping two different sized heat spreaders in inventory.

In another example, the efficiency of the LEDs 120 may increase over time. Thus, fewer LEDs 120 may be used in the future to generate the same light output. As a result, the size of the PCB 118 may be reduced to accommodate fewer LEDs 120. To make a corresponding decrease to the size of the modular heat spreader 114, pieces may be removed rather than redesigning a new heat spreader with a smaller size and keeping two different sized heat spreaders in inventory.

Figure 3:
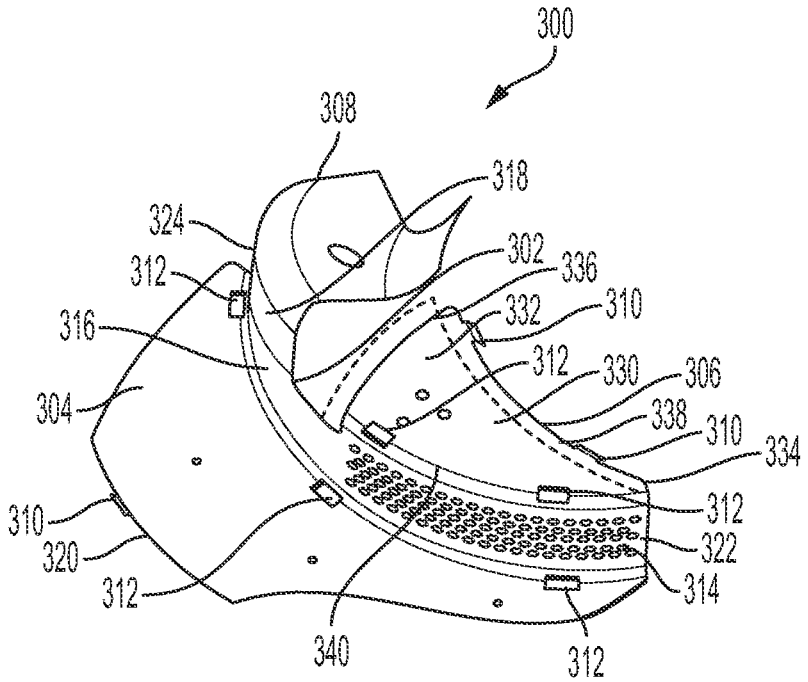
FIG. 3 depicts an isometric view of an example of a single modular heat spreader piece of the modular heat spreader of the high bay luminaire of the present disclosure.

FIG. 3 illustrates an example of a single modular heat spreader piece 300 that can be used to form the modular heat spreader 114. The single modular heat spreader piece 300 may also be referred to herein as the modular piece 300.

In one embodiment, the modular piece 300 may include a body portion 302, a connection member 306, and a heat spreader member 308. The body portion 302 may include a flange member 304. The flange member 304 may be coupled to a first side 316 of the body portion 302. The flange member 304 may have a curved outer edge 320 that matches the curved outer surface of the body portion 302. Said another way, the curved outer surface of the body portion 302 and the curved outer edge 320 of the flange member 304 may have the same radius of curvature.

In one embodiment, the flange member 304 may have a relatively flat surface to provide a supporting surface for the PCB 118 when the modular pieces 300 are connected to form the modular heat spreader 114. The flange member 304 may also include slots 312. Each slot 312 may receive a corresponding hook 310 of an adjacent modular piece 300, as discussed in further detail below. In one embodiment, the flange member 304 may include at least one hook 310 to be inserted into a corresponding slot 312 of an adjacent modular piece 300.

In one embodiment, the connection member 306 may be coupled to a second side 318 at a first end 322 of the body portion 302. The second side 318 may be opposite the first side 316 of the body portion 302.

In one embodiment, the connection member 306 may include a first connection surface 330 and a second connection surface 332 (shown in dashed lines in FIG. 3 and partially obscured by the first connection surface 330). The first connection surface 330 and the second connection surface 332 may be perpendicular to the curved outer surface (or first side 316 and second side 318) of the body portion 302. The first connection surface 330 may be parallel to the second connection surface 332. The first connection surface 330 and the second connection surface 332 may be parallel to the flat surface of the flange member 304. In one embodiment, the second connection surface 332 and the flange member 304 may be on the same plane. In one embodiment, the first connection surface 330 and the second connection surface 332 may be located on opposite lateral edges of the body portion 302.

In one embodiment, the first connection surface 330 may have a shape that begins at a narrow point 334 at the first end 322 of the body portion 302. The first connection surface 330 may gradually increase in width or surface area towards a middle of the body portion 302 up to a broad edge 336. The second connection surface 332 may be similarly shaped.

In one embodiment, the first connection surface 330 may include one or more hooks 310 and one or more slots 312. The hooks 310 may be located on an outer edge 338 of the first connection surface 330. The slots 312 may be located on an inner edge 340 of the first connection surface 330. The second connection surface 330 may also include one or more hooks 310 and one or more slots 312 (not shown and hidden from view in FIG. 3), similarly arranged as the hooks 310 and slots 312 described in relation to the first connection surface 330.

In one embodiment, the heat spreader member 308 may be located on the second side 318 of the body portion 302 on a second end 324 of the body portion 302. The second end 324 and the first end 322 may be on opposite ends of the body portion 302.

Figure 7:
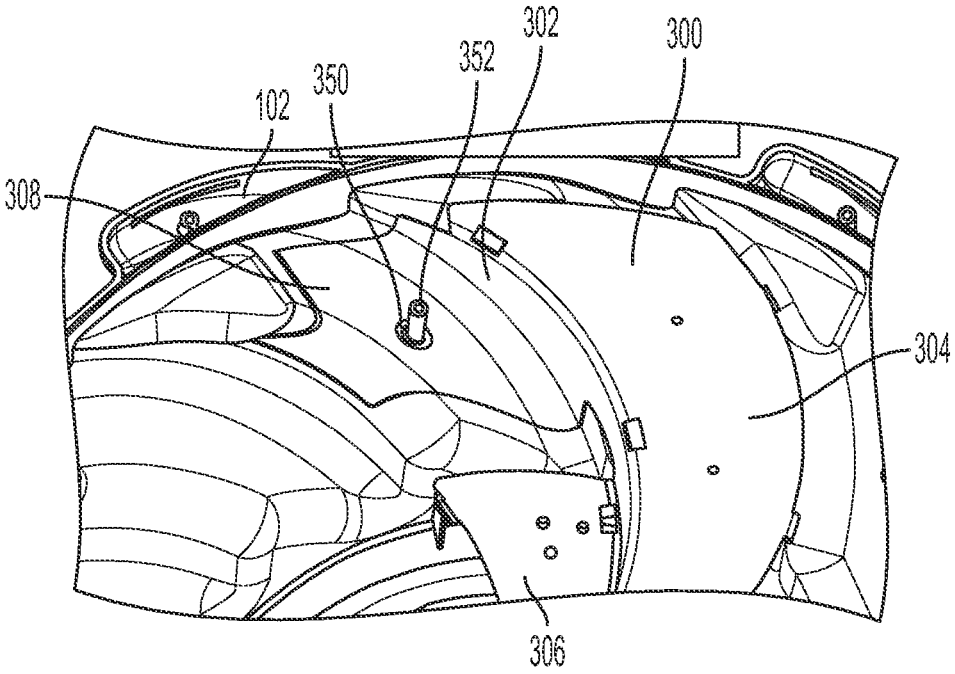
FIG. 7 depicts an example of how a portion of the single modular heat spreader piece is formed to mate with a surface of the housing to dissipate heat away from the LED arrays and to the housing.

The heat spreader member 308 may have a shape profile that is curved or non-flat. The shape profile of the heat spreader member 308 may match a shape profile of a portion of the housing 102 that is contact with the heat spreader member 308. In other words, the shape profile of the heat spreader member 308 may match the shape profile of a portion of the housing 102 such that all points of the surface of the heat spreader member 308 are in contact with the portions of the housing 102 having the same shape profiles as the surface of the heat spreader member 308. FIG. 7 illustrates an example of this and is discussed in further detail below.

In one embodiment, the body portion 102 may include perforations or openings 314. The openings 314 may allow for air flow to improve heat dissipation away from the PCB 118 and the LEDs 120.

Figure 4:
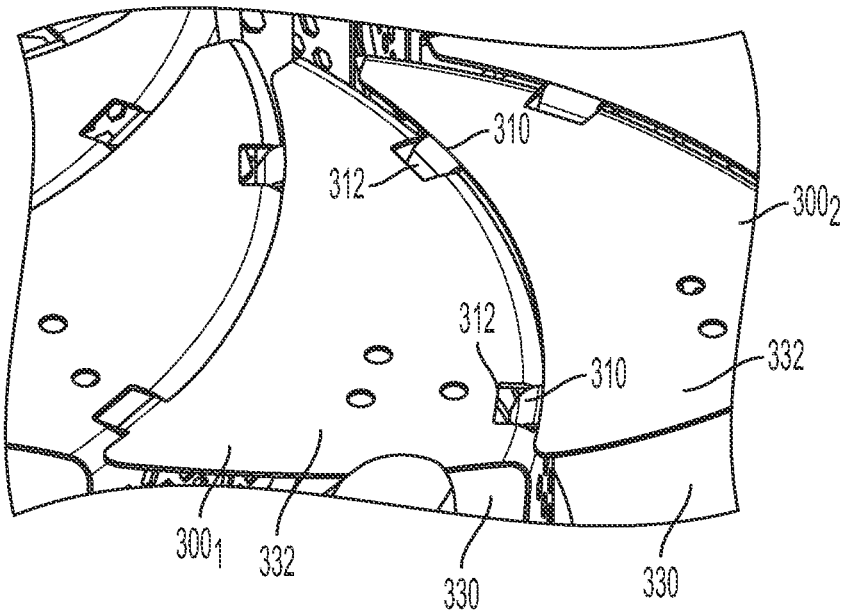
FIG. 4 depicts several modular heat spreader pieces of the modular heat spreader that are assembled together.

FIG. 4 illustrates an example of how adjacent modular pieces 300 may be coupled together to form the modular heat spreader 114 of the present disclosure. FIG. 4 illustrates a view that illustrates how the second connection surfaces 332 are connected. As noted above, but not shown in FIG. 3, the second connection surface 332 may also include hooks 310 and slots 312.

FIG. 4 illustrates an example of how the modular pieces $\mathbf{300}_1$ and $\mathbf{300}_2$ may be coupled together. In one embodiment, the hooks 310 of the second connection surface 332 of the modular piece $\mathbf{300}_2$ are inserted into the corresponding slots 312 of the second connection surface 332 of the modular piece $\mathbf{300}_1$. Similarly, on the opposite side (not shown), the hooks 310 of the first connection surface 330 of the modular piece $\mathbf{300}_2$ may be inserted into the corresponding slots 312 of the first connection surface 330 of the modular piece $\mathbf{300}_1$. This pattern may be repeated for any desired number of modular pieces 300 until a modular heat spreader 114 of a desired diameter is formed.

Figure 5:
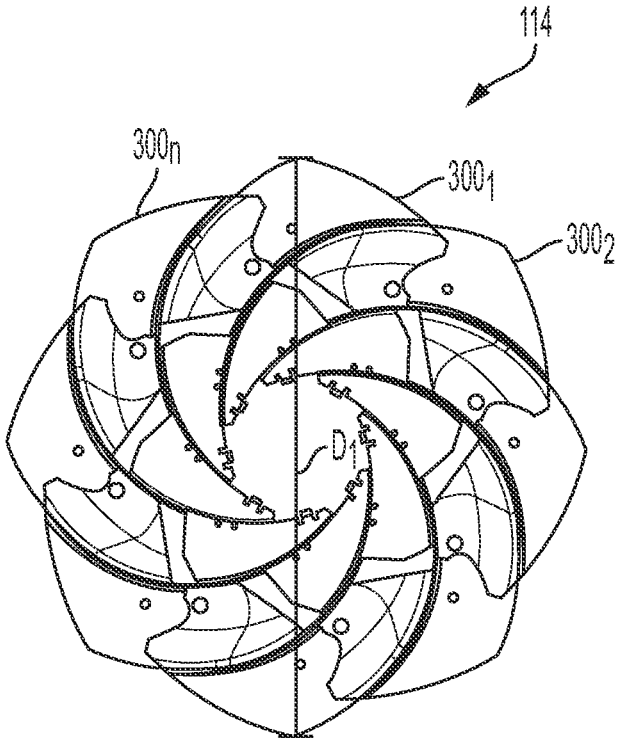
FIG. 5 depicts an example modular heat spreader of a first diameter using the modular heat spreader pieces of the present disclosure.

FIG. 5 illustrates the modular heat spreader 114 having a diameter $D_1$. The modular heat spreader 114 may be formed by connecting modular pieces $\mathbf{300}_1$ to $\mathbf{300}_n$.

Figure 6:
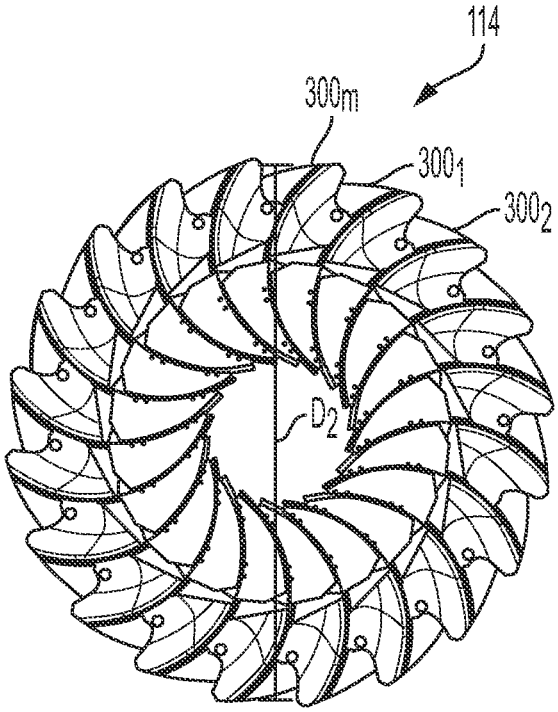
FIG. 6 depicts an example modular heat spreader of a second diameter using the modular heat spreader pieces of the present disclosure.

FIG. 6 illustrates the modular heat spreader 114 having a diameter $D_2$. The diameter $D_2$ may be greater than the diameter $D_1$. The modular heat spreader 114 may be formed by connecting modular pieces $\mathbf{300}_1$ to $\mathbf{300}_m$, where m is greater than n.

Thus, as can be seen in the examples illustrated in FIGS. 3-6, the modular piece 300 can be combined to form various sized modular heat spreaders 114. Thus, a single modular heat spreader piece 300 can be used as a single part for inventory to create a variety of different diameter heat spreaders, thereby reducing overall inventory and manufacturing costs.

As noted above, FIG. 7 illustrates how the heat spreader member 308 has a shape profile that matches the shape profile of the housing 102. FIG. 7 illustrates a view of how the heat spreader member 308, the flange member 304, and the connection member 306 fit inside of the housing 102.

In one embodiment, the heat spreader member 308 may include an opening 350 that corresponds with a post 352 inside of the housing 102. The post 352 may align with the opening 350 to help position the heat spreader member 308 properly inside of the housing 102.

For example, as noted above, there may be a portion of the housing 102 that has a non-flat, or curved, shape profile that matches the shape profile of the heat spreader member 308. When properly aligned, every portion of the heat spreader member 308 may contact a corresponding portion of the housing 102 that has a matching shape profile.

Said another way, if the heat spreader member 308 is not properly aligned with the housing 102, air gaps may be present between the heat spreader member 308 and the housing 102. The air gaps should be minimized as much as possible. The air gaps may act as an insulation layer and may be undesirable, as the air gaps may prevent heat from escaping the luminaire 100 through the heat sink fins 108 of the housing 102. For example, air gaps as low as 0.06 inches may result in excessive insulation and reduced heat transfer. Thus, the air gaps should be as close to zero, or smaller than 0.06 inches, between the heat spreader member 308 and the housing 102.

When the heat spreader member 308 is properly aligned, the heat spreader member 308 may provide a maximum contact surface area to dissipate heat through the housing 102 and out of the luminaire 100. Heat generated by the LEDs 120 may be captured by the aluminum core PCB 118. The PCB 118 may transfer the heat to the flange member 304 that is contact with the PCB 118. The heat may then travel through the body portion 302 to the heat spreader member 308. The body portion 302 may be a relatively thin wall. For example, the body portion 302 may have a thickness of 0.150 inches or less. The heat spreader member 308 may transfer the heat to the housing 102 and allow the heat to be dissipated away to the atmosphere/environment via the heat sink fins 108.

Figure 8:
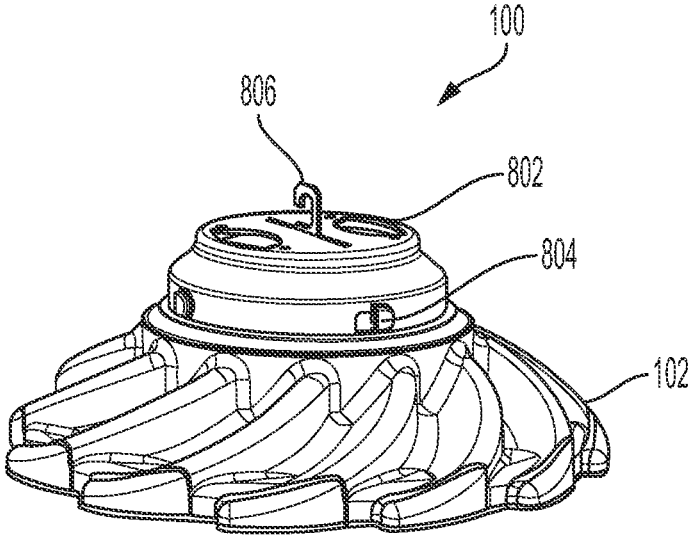
FIG. 8 depicts an isometric top view of the example high bay luminaire with a mounting accessory of the present disclosure.

FIG. 8 illustrates an example of a mounting accessory 802 that may be coupled to the base 104 via the twist lock connector 106 illustrated in FIG. 1 and discussed above. An example of a mounting accessory 802 with a mounting hook 806 is illustrated in FIG. 8. The mounting accessory 802 may have a corresponding twist lock connector 804 that mates with the twist lock connector 106 of the base 104.

Although a twist lock connector 106 is shown in FIGS. 1 and 8, it should be noted that any mechanical connection may be deployed. The mechanical connection may be free from any additional screws, nuts, and/or bolts. For example, the base 104 may include a threaded perimeter to allow a mounting accessory 802 to be screwed on.

However, the twist lock connector 106 may allow the mounting accessory 802 to be properly aligned. For example, the protruding member of the twist lock connector 106 may be set on a fixed location around the base 104. The protruding member may mate with a corresponding opening in the twist lock connector 804 of the mounting accessory 802 to set the mounting accessory 802 in a proper orientation. In contrast, it may be possible to have the mounting accessory 802 in a misaligned position when screwing the mounting accessory 802 onto a base 104 that is threaded. Thus, the twist lock connector 106 may have advantages over other mechanical connections that are free from screws, nuts, and/or bolts.

Although the mounting accessory 802 illustrates a mounting hook example, different types of mounting accessories can be easily switched out via the twist lock connector 106. For example, another mounting accessory may include a conduit with a threaded end, another mounting accessory may include a base with an opening for a mechanical fastener (e.g., bolt and nut connection), another mounting accessory may include a magnet for a magnetic connection, and so forth.

Thus, the base 104 with the twist lock connector 106 may provide flexibility in the way the luminaire 100 is mounted or fixed to a particular location. The desired mounting connection may be quickly connected to the base 104 for efficient mounting and installation.

Figure 9:
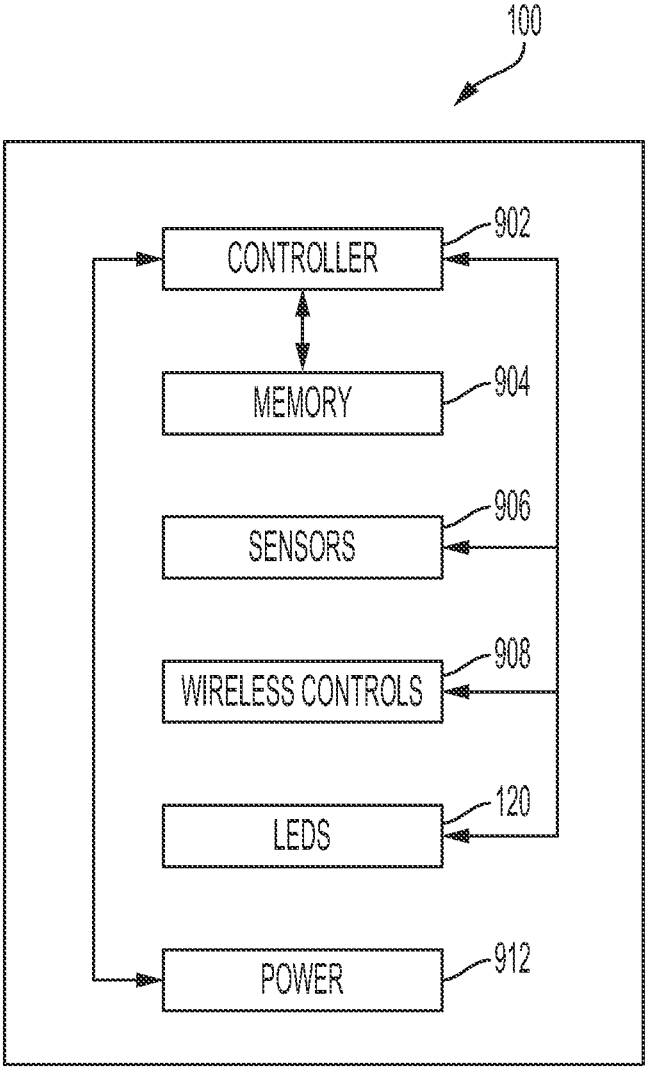
FIG. 9 depicts a block diagram of some example internal components of the example high bay luminaire of the present disclosure.

FIG. 9 illustrates a block diagram of electrical components of the luminaire 100. In one embodiment, the luminaire 100 may include a controller or processor 902, a memory 904, sensors 906, wireless controls 908, the LEDs 120, and a power source 912. In one embodiment, the controller 902 may be communicatively coupled to the memory 904, the sensors 906, the wireless controls 908, the LEDS 120, and the power source 912.

The power source 912 may deliver power to operate the LEDs 120. The power source 912 may also deliver power to operate the controller 902 and other electrical components, such as the sensors 906, the wireless controls 908, and the like.

In one embodiment, the controller 902 may control an amount of power delivered to the LEDs 120 to control a light output of the luminaire 100. For example, the controller 902 may cause power to be delivered to different arrays of LEDs 120 to control the light output of the luminaire 100. In another example, the controller 902 may regulate the amount of power delivered to the LEDs 120 to control an amount of light output generated by each LED 120, and so forth.

In one embodiment, the memory 904 may store various information. The information can be information that is received by the NFC tag 150, as described above. The information may also be accessed by the NFC tag 150 when requested by scanning the NFC tag 150. The information may include part information, a maintenance history, operational parameters, operational history of the luminaire 100, digital twin asset information, and the like.

In one embodiment, the sensors 906 may include a photo sensor to detect an amount of ambient light. The luminaire 100 may be programmed to automatically turn on when an amount of ambient light falls below a threshold. The sensors 906 may include a motion detector. For example, the luminaire 100 may be programmed to automatically turn on when motion is detected.

In one embodiment, the wireless controls 908 may include a receiver and/or transmitter that allows for wireless communications. The wireless controls 908 may allow the luminaire 100 to be controlled remotely from a central server or control center.

Although various electrical components are illustrated in FIG. 9, it should be noted that other electrical components may be included that are not shown. For example, the luminaire 100 may include other communication modules, capacitors, alternating current (AC) to direct current (DC) converters, DC to AC convertors, power regulators, and the like.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A single modular heat spreader piece, comprising:

a body portion, wherein the body portion comprises a curved outer surface and a flange member coupled to a first side of the body portion, wherein the flange member has a curved outer edge;

a connection member coupled to a second side of the body portion, wherein the second side of the body portion is opposite the first side; and a heat spreader member coupled to the second side of the body portion and on an opposite end of the body portion from the connection member.

2. The single modular heat spreader piece of claim 1, wherein the heat spreader member has a shape profile that matches a shape profile of a housing of a luminaire.

3. The single modular heat spreader piece of claim 2, wherein the shape profile of the heat spreader member and the shape profile of the housing of the luminaire comprise irregular shaped surfaces to create an extended surface to enhance heat transfer.

4. The single modular heat spreader piece of claim 1, wherein the connection member comprises:

a first connection surface that is perpendicular to the body portion; and a second connection surface that is perpendicular to the body portion and parallel to the first connection surface.

5. The single modular heat spreader piece of claim 4, wherein the first connection surface and the second connection surface are on opposite lateral edges of the body portion.

6. The single modular heat spreader piece of claim 4, wherein the first connection surface and the second connection surface each comprise:

a hook on an outer edge; and a slot on an inner edge adjacent to a lateral edge of the body portion.

7. The single modular heat spreader piece of claim 1, wherein the body portion comprises a plurality of openings in the curved outer surface for air flow.

8. The single modular heat spreader piece of claim 1, wherein the curved outer surface of the body portion and the curved outer edge of the flange member have a same radius of curvature.

9. A modular heat spreader for a luminaire, comprising:

a plurality of single modular heat spreader pieces coupled together, wherein each one of the plurality of single modular heat spreader pieces comprises:

a body portion, wherein the body portion comprises a curved outer surface and a flange member coupled to a first side of the body portion, wherein the flange member has a curved outer edge;

a connection member coupled to a second side of the body portion, wherein the second side of the body portion is opposite the first side; and a heat spreader member coupled to the second side of the body portion and on an opposite end of the body portion from the connection member.

10. The modular heat spreader of claim 9, wherein the heat spreader member has a shape profile that matches a shape profile of a housing of the luminaire.

11. The modular heat spreader of claim 10, wherein the shape profile of the heat spreader member and the shape profile of the housing of the luminaire comprise irregular shaped surfaces to create an extended surface to enhance heat transfer.

12. The modular heat spreader of claim 9, wherein the connection member comprises:

a first connection surface that is perpendicular to the body portion; and a second connection surface that is perpendicular to the body portion and parallel to the first connection surface.

13. The modular heat spreader of claim 12, wherein the first connection surface and the second connection surface are on opposite lateral edges of the body portion.

14. The modular heat spreader of claim 12, wherein the first connection surface and the second connection surface each comprise:

a hook on an outer edge; and a slot on an inner edge adjacent to a lateral edge of the body portion, wherein the hook is to engage a slot of a first adjacent single modular heat spreader piece and the slot is to receive a hook of a second adjacent single modular heat spreader piece.

15. The modular heat spreader of claim 9, wherein the plurality of single modular heat spreader pieces are coupled together to form a circular shape.

16. A high bay luminaire, comprising:

a housing comprising a twist lock connector;

a modular heat spreader coupled to the housing, wherein the modular heat spreader comprises a plurality of single modular heat spreader pieces coupled together, wherein each one of the plurality of single modular heat spreader pieces comprises:

a body portion, wherein the body portion comprises a curved outer surface and a flange member coupled to a first side of the body portion, wherein the flange member has a curved outer edge;

a connection member coupled to a second side of the body portion, wherein the second side of the body portion is opposite the first side; and a heat spreader member coupled to the second side of the body portion and on an opposite end of the body portion from the connection member;

a printed circuit board comprising a plurality of light emitting diodes (LEDs), wherein the printed circuit board is coupled to the heat spreader member; and a lens coupled to the housing to enclose the modular heat spreader and the printed circuit board.

17. The high bay luminaire of claim 16, wherein the twist lock connector provides a connection to different types of mounting accessories.

18. The high bay luminaire of claim 16, further comprising:

a near field communication (NFC) tag coupled to the housing.

19. The high bay luminaire of claim 18, wherein the NFC tag provides information for a digital twin.

20. The high bay luminaire of claim 18, wherein the NFC tag is to store part numbers and maintenance records.

* * * * *